United States Patent [19]

Fegley

[11] 4,062,473

[45] * Dec. 13, 1977

[54] CHEMICAL DISPENSING ANTI-BURGLAR BOOBY TRAP DEVICE

[76] Inventor: Charles R. Fegley, 1606 Fresh Valley Road, Laureldale, Pa. 19605

[ * ] Notice: The portion of the term of this patent subsequent to Jan. 6, 1993, has been disclaimed.

[21] Appl. No.: 670,059

[22] Filed: Mar. 24, 1976

Related U.S. Application Data

[63] Continuation-in-part of Ser. No. 451,091, March 14, 1974, abandoned.

[51] Int. Cl.[2] ..... B67B 7/24

[52] U.S. Cl. ..... 222/5; 222/325

[58] Field of Search ..... 222/3, 5, 61, 81, 83, 222/83.5, 88, 173, 180, 325, 402.14; 109/20, 21, 29, 31, 38; 116/75, 85-87

[56] References Cited

U.S. PATENT DOCUMENTS

| | | | |
|---|---|---|---|
| 2,206,818 | 7/1940 | Mapes | 222/5 |
| 2,732,017 | 1/1956 | Fleming | 222/83 |
| 3,180,524 | 4/1965 | Shepard et al. | 222/5 |
| 3,198,384 | 8/1965 | Anderson | 222/83.5 |
| 3,236,418 | 2/1966 | Dalle et al. | 222/325 |
| 3,278,093 | 10/1966 | Lehmann | 222/402.17 |
| 3,528,339 | 9/1970 | Bernhardt et al. | 222/5 |
| 3,930,597 | 1/1976 | Fegley | 222/83.5 |

FOREIGN PATENT DOCUMENTS

| | | | |
|---|---|---|---|
| 555,233 | 1/1957 | Italy | 9/316 |
| 854,003 | 11/1960 | United Kingdom | 222/5 |
| 1,286,175 | 8/1972 | United Kingdom | 222/180 |

*Primary Examiner*—Stanley H. Tollberg
*Assistant Examiner*—H. Grant Skaggs

[57] ABSTRACT

A chemical dispensing anti-burglar booby trap device is disclosed from which a chemical such as tear gas is discharged into an area to be protected when an intruder opens a window or a door or forces open a window or a door to enter an unauthorized area with which the device is associated. The anti-burglar booby trap device employs a spring biased actuating member for discharging a chemical from a pressurized container. An improved trigger for releasably retaining the actuating member in a cocked position and for releasing the chemical are described.

18 Claims, 28 Drawing Figures

48

CHEMICAL DISPENSING ANTI-BURGLAR BOOBY TRAP DEVICE

This is a continuation of application Ser. No. 451,091, filed 3-14-74, and now abandoned.

BACKGROUND OF THE INVENTION

The invention relates generally to an anti-burglar booby trap device and more particularly to an anti-burglar booby trap device which discharges a chemical such as tear gas from a pressurized container into the protected area. Actuation by an unauthorized person causes the protected area to be flooded with the chemical and thereby forces evacuation of the protected area by the intruder.

Chemical weapons have been known in the art for many years. One type of chemical weapon is the conventional tear gas grenade which is generally triggered manually and the grenade is manually hurled at a target area, causing the target area to be flooded with the chemical.

In another type of chemical weapon, the chemical is stored under pressure in an aerosol type container. The actuating member is generally triggered manually and the chemical in the form of a spray is manually directed at a target.

A third type of chemical anti-burglary device discharges an explosive tear gas shell into the area but this type is both dangerous and very limited as to the amount of tear gas which is discharged into the area to be protected.

Thus what is needed is an anti-burglar booby trap device in the form of a chemical dispenser which can be discharged by a relatively small amount of mechanical force even though the device employs a relatively heavy spring for biasing the actuating member against the dispensing element of the pressurized container. The actuating member contains a dispensing element actuating means for actuating the dispensing element of the pressurized container. The spring must be sufficiently strong to force the dispensing element actuating means into engagement with and to actuate the dispensing element whereby the chemical is released from the pressurized container. In addition, the anti-burglar device can be positively secured against accidental release until triggered by an intruder. When triggered, the device will then release a sufficient volume of the chemical into the protected area to force evacuation by the intruder.

SUMMARY OF THE INVENTION

The principle object of the present invention is to provide an anti-burglar device of the chemical dispensing type which may be triggered directly by a small amount of mechanical movement, and yet is positively secured against accidental release.

A further object of the invention is to provide an anti-burglar device of the chemical weapon type which is readily triggered by opening a door, window, or ceiling skylight by an intruder entering an unauthorized area or by moving an object with which the device is connected.

Another object of the invention is to provide an improved means of dispensing the chemical into the protected area in a minimum amount of time in order to force the intruder from the protected area and to prevent the intruder from re-entering the protected area for a reasonable amount of time.

Another object of the present invention is to provide a directable discharge of the chemical, such as by means of rotatably adjustable dispensing head, so that the invention might be located on a door, wall, or the like, and yet, when the device is actuated, the discharged chemical is directed into the area to be protected.

According to the principle aspect of the present invention there is provided an improved means for releasably retaining the spring biased actuating member of the anti-burglary device in its cocked position. Such means includes a trigger adapted to be movably mounted between an actuation position and in a release position. A cord, cable, wire or the like, connects the trigger to a window, door or other object which might be moved by an unauthorized person entering a room or building, or across a walkway or other area from which it is desired to restrict unauthorized persons, When the trigger is in its actuation position, it retains the actuating member in a cocked position. When the door or window associated with the device is opened by an unauthorized person, or when the object is moved by an unauthorized person or when the person enters the restricted area, the cord connected to the trigger moves the latter from engagement to a release position; thereby releasing and permitting the actuating member to be thrust toward the pressurized container by the force of the spring associated with the actuating member and causing the chemical to be discharged into the protected area.

Since the trigger which serves to retain the actuating member in its cocked position has mechanical advantage, a relatively small amount of force is required to move the trigger from engagement with the actuating member. Even more important, a relatively small amount of force is required to move the trigger to discharge the chemical weapon, even though a relatively strong spring is employed for forcing the actuating member toward the pressurized container. As a consequence, the cord connected to the trigger in the present invention will not break in triggering the pressurized container. The resistance to movement of the cord connected to the trigger is sufficiently low so as not to be observed by an intruder. Nevertheless, the trigger serves to retain the actuating member safely in its cocked position against accidental release.

Alternatively, the chemical dispensing anti-burglar device may be connected to an electric circuit to effect discharge when the electric circuit is completed. The device may, therefore, be used in existing anti-intrusion or anti-burglar systems or may be connected to a switch and a power source. Upon energization, an electromechanical actuation releases the triggering element thereby releasing the actuating member to cause the pressurized container to discharge its contents.

An additional method of retaining the trigger is to control the trigger with a fusible link such that the trigger is held in position until an electric current is passed through the fusible link causing it to melt, thus releasing the trigger and actuating member, thereby causing the pressurized container to discharge the chemical.

The anti-burglary device of the chemical weapon type of the present invention may be utilized in homes, factories, farms, office buildings by attaching the device to doors, windows, skylights, etc. and may be used in connection with boats, trucks, etc. The device may also be employed for any other application wherein it is desired to prevent unauthorized persons from moving certain objects by placing the mounted device against any wall or other object to prevent the unlocked device from discharging until unauthorized movement of the subject objects.

Once actuated, the dispensing action cannot be turned off by the intruder and the entire amount of the pressurized chemical will be discharged into the protected area making it impossible for the intruder to remain in the protected area without having protective equipment.

Other objects, aspects and advantages of the invention will become apparent from the following description taken in connection with the accompanying drawings.

DESCRIPTION OF THE PREFERRED EMBODIMENTS

Figure 1:
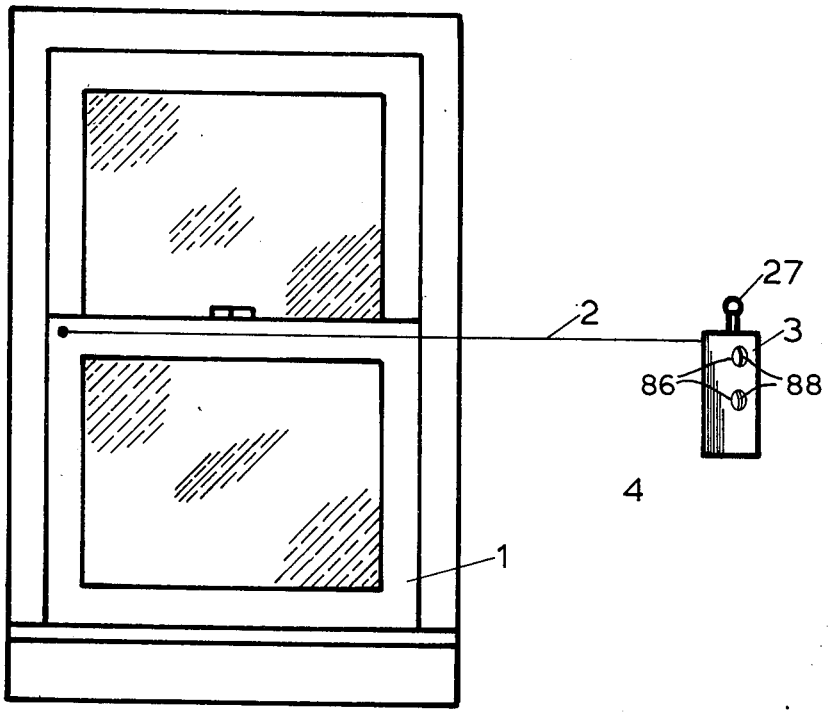
FIG. 1 is an elevational view of a wall of a room having one embodiment of the chemical dispensing anti-burglar device of the present invention secured to the wall and connected by means of a cord to the sash of a window in the wall.
Figure 2:
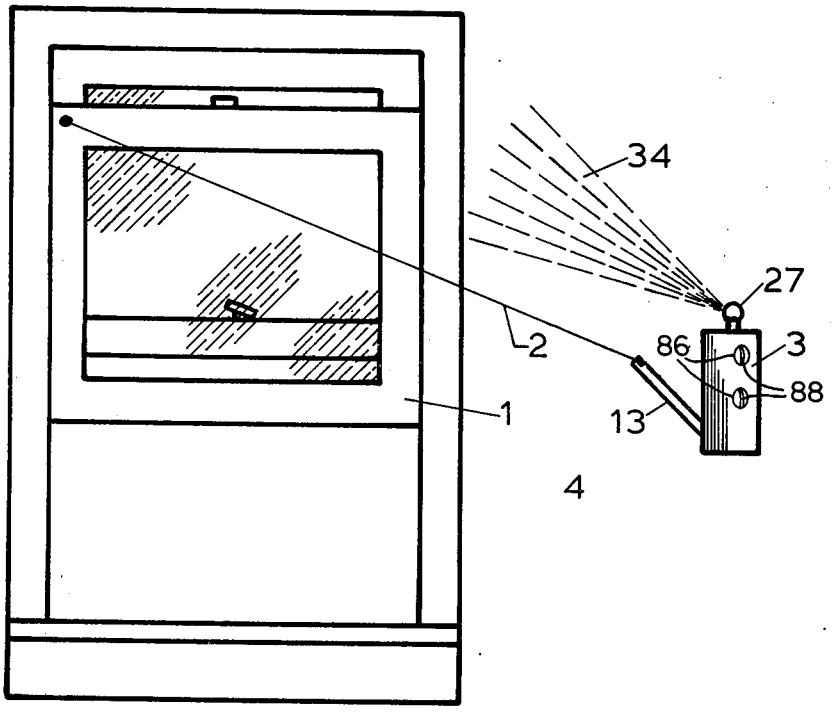
FIG. 2 is an elevational view similar to FIG. 1, but showing the window open and showing the device discharging.
Figure 3:
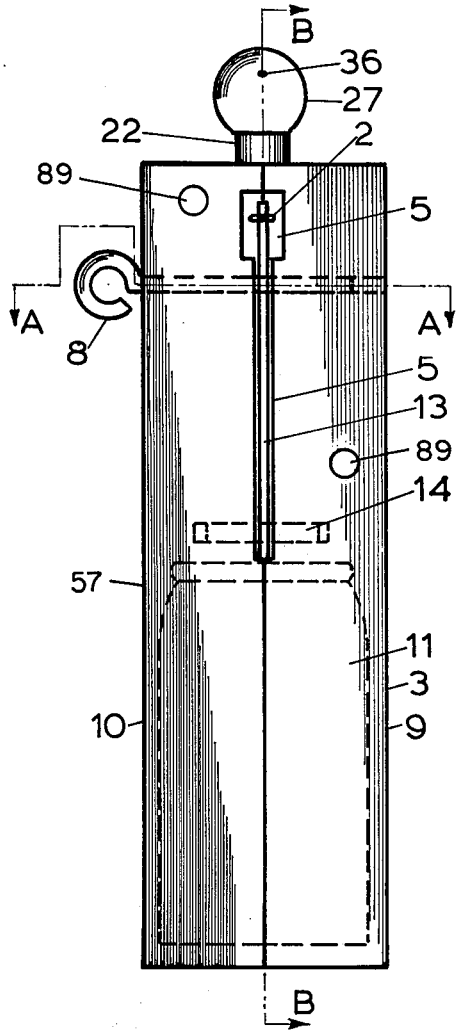
FIG. 3 is a front elevational view of the chemical dispensing anti-burglar device.

Referring now to the drawings in detail, wherein like reference characters designate like parts throughout the various views, there is shown in FIGS. 1–6, one form of the chemical dispensing anti-burglar device, called device hereafter, of the chemical weapon type according to the present invention, generally designated 3. The device 3 is shown for convenience as being secured to a wall 4 and connected by means of a cord 2 to a window sash 1 in the wall 4 so that upon opening of the window sash 1 by a burglar or an intruder, the device 3 will be actuated to discharge a chemical 34 into the restricted area. The device 3 whose front is shown in FIG. 3 comprises of a pressurized chemical container 11, called pressurized container hereafter, mounted in a body member 57 shown for convenience as comprising of a right body half 9 and a left body half 10. The body halves 9 and 10 when assembled provide three flat sides, other than the front, for mounting the device 3 to the wall 4 adjacent to the window sash 1 or elsewhere, as may be convenient with screws 88 inserted through the holes 86 in body member 57.

Figure 5:
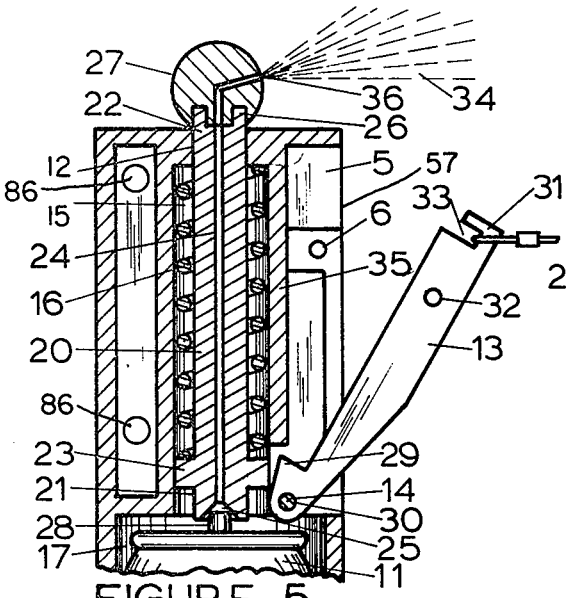
FIG. 5 is a partial vertical section taken along line B—B of FIG. 3 similar to FIG. 4 but showing the actuating member in its release position after the device has been triggered.
Figure 6:
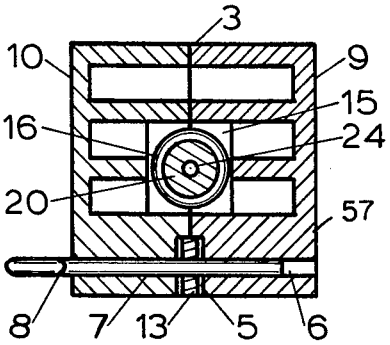
FIG. 6 is a partial horizontal section taken along line A—A of FIG. 3 with the trigger locked by a safety pin.

The coaxial cylindrical bores 12, 15 and 17, as shown in FIG. 5, are formed when the symetrically opposite body halves 9 and 10 are joined together as shown in FIGS. 3 and 6. The cylindrical bores 12 and 15 slidably mount a cylindrical actuating member 20 which is coaxial with bores 12 and 15. The cylindrical actuating member 20 has a forward section 21 which is separated from the top main section 22 of the actuating member 20 by means of an annular flange section 23. The top main section 22 of the actuating member 20 is slidably mounted in bore 12 which is coaxial with bore 15 while the annular flange section 23 is slidably mounted in bore 15.

The stepped cylindrical bore generally designated 17 supports the pressurized container 11 which is held in its proper position. The pressurized container 11 of which one type is sold by Defense Products Manufacturing Corporation, 1628 South Hanley Rd., St. Louis, Mo. identified as their "Paralyzer" and another type is sold by Penquin Industries, Inc., Parkesburg, Pa. identified as their "10-4 Chemical Billy" but the invention is not limited to the use of these containers. The pressurized container 11 includes a fluid dispensing element which comprises of a spring urged projecting dispensing spout 28 which when depressed in the direction of arrow 18 discharges a chemical 34 through the center of the dispensing spout 28. The cylindrical actuating member 20 contains a fluid passageway 24 having an entry section 25 on the bottom and a coaxial hole 26 on the top to mount a rotatable dispensing head 27. The fluid passageway 24 and the dispensing head 27 provide a means for the chemical to be discharged when the entry section 25 of actuating member 20 is forced over and depresses projecting the dispensing spout 28 by the coil spring 16. It is important that the cylindrical actuating member 20 contain a dispensing element actuating means at the entry section 25 which is shown as being funnel shaped so that when the entry section 25 engages the dispensing spout 28, means for forming a seal between the entry section 25 and the dispensing spout 28 is formed by the funnel shape of entry section 25 and the slight deformation of the dispensing spout 28 at the point of contact. The dispensing spout 28 is made of a relatively soft material and therefore provides an adequate seal in the funnel shape of the entry section 25 to retain fluid flow in the passageway at pressures normally used in the pressurized container 11.

Figure 27:
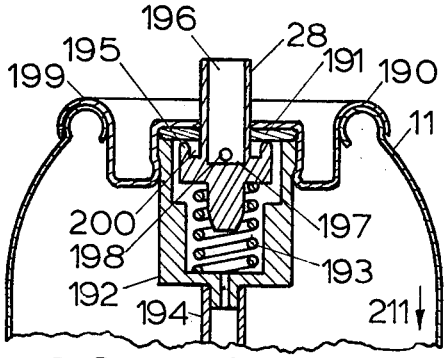
FIG. 27 is a partial vertical section showing a valve having a projecting spout for use with a pressurized container.

One type of pressurized container 11, shown as having a fluid-dispensing element in the form of a projecting dispensing spout 28, for use in this embodiment is shown in FIG. 27 as containing a valve assembly generally designated 190. Valve assemblies of this type are well known in the trade and one type of which is sold by Scovill, Manchester, N.H. as their S-63 valve assembly. The valve assembly 190 is shown as being comprised of a projecting dispensing spout 28 which has generally a hollow tube portion 196 and is closed at one end 197 thereof. A valve seat 195 is formed around the sealed end 197 of the dispensing spout 28 and contains a recessed portion 200 formed to provide a fluid passageway which will permit fluid flow to a discharge hole 198 and gives fluid access to the hollow tube 196. The dispensing spout 28 is slidably mounted in spring cup 192 and is urged by spring 193 toward the valve seal 191. In this position, the valve seat 195 forms a seal with the valve seal 191. A dip tube 194 may be attached to the spring cup 192 to provide access to fluid when in liquid form in the bottom of the container 11. The assembly is generally mounted in a metal cup 199 which is then fastened to the container 11.

When the projecting dispensing spout 28 is moved in direction 211, the valve seat 195 is separated from the valve seal 191 thereby, permitting fluid under pressure to flow up dip tube 194, around the valve seat 195, through the discharge hole 198 and out the hollow tube 196.

Figure 4:
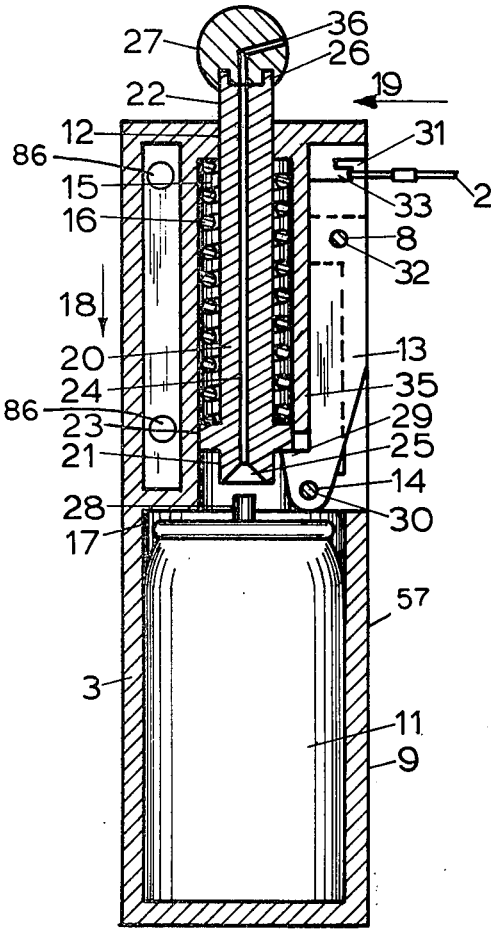
FIG. 4 is a vertical section taken along line B—B of FIG. 3 showing the actuating member in its cocked position displaced from the projecting dispensing spout of the pressurized container.

The coil spring 16 surrounds the main section 22 of the actuating member 20 between the top end of the bore 15 and the annular flange section 23 of the actuating member 20. The actuating member 20, in the position illustrated in FIG. 4, is in its cocked position where the spring 16 is compressed and the entry section 25 of the actuating member 20 is spaced from the projecting dispensing spout 28 of the pressurized container 11. The actuating member 20 is releasably restrained in said cocked position by a trigger 13, which is best seen in FIG. 4. The trigger 13 is shown for convenience as being a flat member and includes a shaped portion shown as a latch 29 and holes 30 and 32 as best seen in FIGS. 4 and 5. The trigger 13 is rotatably mounted on pin 14 and slidably mounted in slot 5 formed by the body halves 9 and 10. The latch 29 of trigger 13 engages the flanged section 23 of the actuating member 20. The spring 16 urged actuating member 20 acting on latch 29 causes trigger 13 to rotate in the direction of arrow 19 and therefore will be held against the left most end of slot 5 formed by the body halves 9 and 10, thus retaining the actuating member 20 in its cocked position.

A means for locking the actuating member 20 in its cocked position and the trigger 13 in its actuation position is shown for convenience as being comprised of a safety pin 8 mounted to prevent movement of trigger 13. The pin 8 passes through passage 7 in the left body half 10, a passage 32 in trigger 13 and a passage 6 in the right body half 9 as shown in FIGS. 4, 5 and 6. All passages are transverse to the longitudinal axis of the actuating member 20 and are aligned when actuating member 20 is in its cocked position as seen in FIGS. 4, and 6.

A trigger actuating means associated with trigger 13 and arranged to actuate trigger 13 is shown for convenience as including a cord 2. A notch 33 is provided near the top end 31 of trigger 13 for receiving cord 2. The cord 2 is connected at one end to the window sash 1 and at its other end to the trigger 13 by being looped over trigger 13 to engage in notch 33. When it is desired to place the device in condition for discharge upon opening of sash 1, the safety pin 8 is removed from passages 6, 32 and 7. If the window sash 1 is opened by a burglar or other intruder, the cord 2 will rotate the trigger 13 moving the trigger latch 29 out of engagement from flange section 23 of the actuating member 20, and permitting the actuating member 20 to be thrust toward the projecting dispensing spout 28 of the pressurized cylinder 11 by means of the spring 16 to the position illustrated in FIG. 5. In this position, the dispensing element actuating means in the form of the entry section 25 of the actuating member 20 depresses the dispensing spout 28 of the pressurized container 11 causing the chemical 34 to be discharged through the passageway 24 then into the area to be protected as shown in FIG. 2.

It is also important in this embodiment that the fluid-dispensing element comprises of a dispensing valve 190 having a projecting dispensing spout 28 which when depressed causes fluid discharge therethrough. The fluid passageway 24 contains the fluid dispensing-actuating means in the form of a funnel shaped entry section 25 which engages the projecting dispensing spout 28 and forms a seal between the entry section 25 of passageway 24 and the projecting dispensing spout 28.

It is an important feature that the trigger 13 be rotatable in this embodiment and that the trigger latch 29 slide freely on the flange section 23 of the actuating member 20 and, hence, present a surface which will ride smoothly when the trigger 13 is pulled. As a consequence, the trigger 13 may be easily withdrawn from engagement without substantial force. Yet, when the trigger 13 is positioned in engagement with flange section 23 on the actuating member 20 it serves to positively retain the actuating member 20 in its cocked position. Hence, substantially less force is required to trigger the device 3 of the present invention than would be required if the actuating member 20 were retained in its cocked position by means of a transversely extending trigger, yet, the actuating member 20 is still safely retained in its cocked position against accidental release by the trigger 13. Another important feature is that the spring 16 be of substantial force so that actuating member 20 will depress the dispensing spout 28 sufficiently to cause the chemical 34 to be discharged from the dispensing spout 28 of the pressurized cylinder 11.

Figure 7:
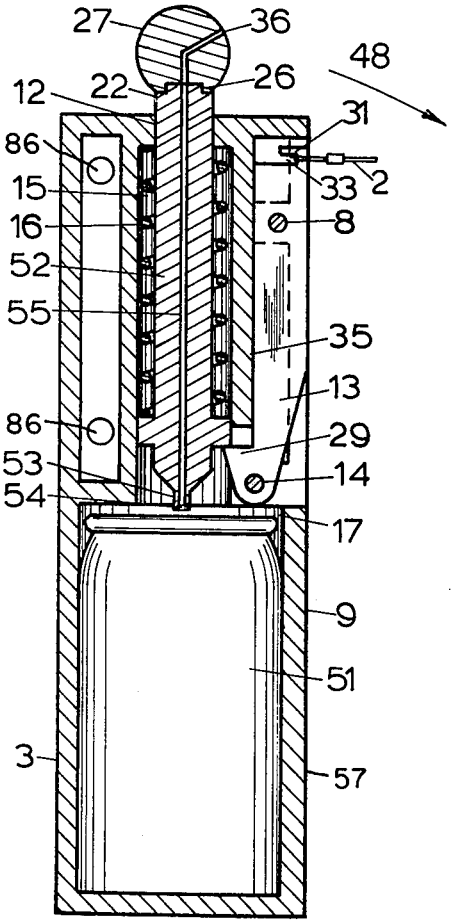
FIG. 7 is a partial vertical section similar to FIG. 4 but showing a second embodiment of the anti-burglar device containing a pressurized container having a recessed valve.

A second embodiment of the invention is illustrated in FIG. 7. In this embodiment the basic structure is as previously described and like numbers are used to indicate like or corresponding parts.

In this embodiment, the pressurized chemical container 11, shown in FIG. 4 as having a projecting dispensing spout 28, is replaced with a pressurized chemical container 51, shown in FIG. 7, having a recessed valve. Pressurized containers with a recessed dispensing valve are well known in the trade. In addition, the forward section 21 and the entry section 25 of the actuating member 20 of the first embodiment shown in FIG. 4 is replaced with an actuating member 52 having a projecting forward section 53 and an entry section 54 all of which are shown in FIG. 7.

In this embodiment, all elements function as described in the first embodiment with the following difference. The pressurized container 51 is discharged by the action of the coil spring 16 forcing projecting forward section 53 of the actuating member 52 to engage with and to depress the recessed valve of the pressurized container 51 when the device is triggered and thereby effects discharge.

Figure 28:
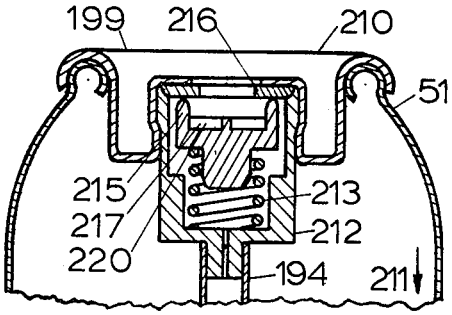
FIG. 28 is a partial section showing a recessed valve for use with a pressurized container.

One type of recessed valve for use in this embodiment is shown in FIG. 28 and is generally designated 210. Valve assemblies of this type are well known in the trade and one type of which is sold by Scovill, Manchester, New Hampshire. The valve assembly 210 is shown as being comprised of a valve seat 215 mounted in a spring cup 212. The valve seat 215 contains a recessed portion 220 and recessed channels 217 formed in valve seat 215.

The valve seat 215 is slidably mounted in spring cup 215 and is urged by spring 213 toward valve seal 216. In this position, the valve seat 215 forms a seal with the valve seal 216. The valve assembly 210 is generally mounted in a metal cup 199 which is then fastened to the pressurized container 51.

When the device is actuated, the valve assembly 210 is depressed by the projecting forward section 53 which is formed around the entry section 54 of passageway 55 of the actuating member 52. As movement continues, the projecting forward section 53 of the actuating member 52 engages with and moves the valve seat 215 from engagement with valve seal 216 permitting fluid under pressure to flow around the valve seat 215 through the discharge channels 217 into entry section 54 and out of passageway 55. When the projecting foward section 53 around the entry section 54 entered the valve assembly 210, the valve seal 216, being made of resilient material, formed a seal between the circumference of the projecting forward section 53 and the valve seal 216, thus preventing fluid leakage.

The chemical 34 is then discharged through the valve 210 of the pressurized container 51, through the entry section 54 and passageway 55 and out the dispensing head 27, then into the area to be protected.

It is important in this embodiment that the fluid-dispensing element comprises of a recessed valve assembly 210 which when depressed causes fluid discharge. It is also important that the biased actuating member 52 includes a fluid dispensing element actuating means in the form of a projection around said entry section 54, shown as a projecting forward section 53, extending toward the container 51. The projecting forward section 53 engages with and depresses the valve seat 215, moving the valve seat 215 from the valve seal 216 whereby fluid will be discharged.

The chemical is then discharged through the valve of the pressurized container 51, through the entry section 54 and passageway 55 and out the dispensing orifice 36, then into the area to be protected.

Figure 8:
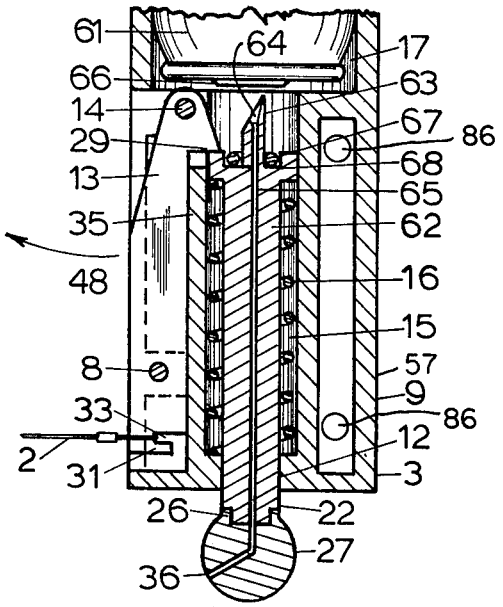
FIG. 8 is a partial vertical section similar to FIG. 4 but showing a third embodiment of the anti-burglar device containing a pressurized container of the type with a pierceable seal and a means for piercing the seal.

A third embodiment of the invention is illustrated in FIG. 8. In this embodiment the structure is as previously described in the first embodiment and like numbers are used to indicate like or corresponding parts.

In this embodiment, the pressurized chemical container 11, shown in FIG. 4 of the first embodiment as having a projecting dispensing spout 28, is replaced with a pressurized chemical container 61 shown in FIG. 8, having a piercable section 66. Pressurized container having pierceable section are well known in the trade. In addition, the forward section 21 and the entry section 25 of the actuating member 20 of the first embodiment shown in FIG. 4 is replaced with a actuating member 62 having a projecting forward section 63 shaped around entry section 64 to pierce piercable section 66 and a means of making a seal capable of withstanding the pressure required for effectively discharging the chemical into the entry section 64 and through the passageway 65 and into the restricted area.

Now referring to FIG. 8, FIG. 8 is an inverted embodiment of FIG. 4 of the first embodiment in which all elements function as described in the first embodiment with the following exceptions. The actuating member 62, when released by the trigger 13, is forced into piercable engagement with the piercable section seal 66 of the pressurized container 61 by the action of spring 16. As the piercable section seal 66 is pierced by the action of the projecting forward section 63 of the actuating member 62; the actuating member 62 continues to move by the urging of the spring 16 whereby the means for forming a seal forms a seal by the action of the O-Ring 67 and its retaining seat 68 and the piercable section 66 of the pressurized container 61. The chemical 34 is then discharged through the pierced seal section 66 of the pressurized container 61, into the entry section 64, through passageway 65, out the orifice 36, and then into the area to be protected.

It is important in this embodiment that the fluid-dispensing element comprises a piercable section seal 66 which when pierced will permit fluid discharge therethrough. It is also important that the dispensing element actuating means comprise of a projecting forward section 63 set in a position to pierce the piercable section 66 when the pressurized container 61 is moved toward it. It is also important that a seal be made around the projecting forward section 63 to prevent fluid leakage within the body member 11 after the piercable section 66 is pierced. It is also important in this embodiment that the dispensing element actuating means in the shape of the projecting forward section 63 formed around the entry section 64 is of substantial strength that it will not bend or deflect; but that it will efficiently pierce the fluid-dispensing element in the form of a piercable section 66.

Figure 10:
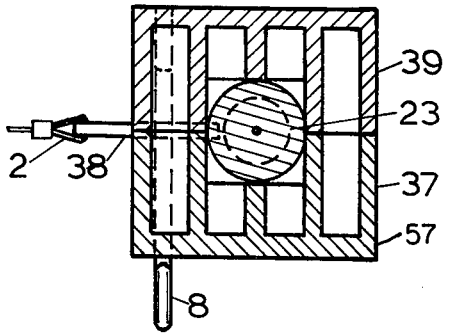
FIG. 10 is a partial horizontal section taken along line H—H of FIG. 9.
Figure 9:
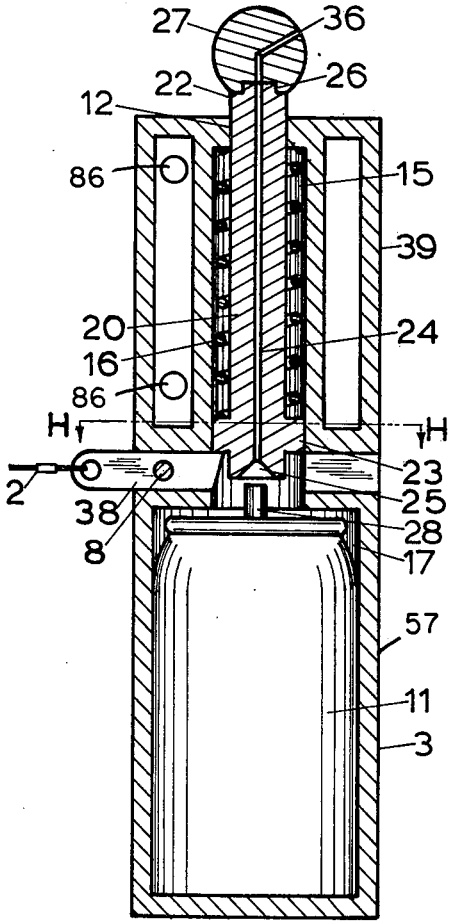
FIG. 9 is a partial vertical section similar to FIG. 4 but showing a fourth embodiment of the anti-burglar device wherein the trigger is slidably mounted.

The preceeding embodiments of the invention show the chemical dispensing anti-burglar device in its preferred embodiments having a rotatable trigger designed for mechanical advantage but it is recognized that the trigger may be slidably mounted as shown in FIGS. 9 and 10.

Therefore a fourth embodiment of the invention is illustrated in FIGS. 9 and 10. In this embodiment the basic structure is as previously described in the first embodiment and like numbers are used to indicate like or similar parts.

In this embodiment, the rotatable trigger 13 is replaced with a slidable trigger 38 and body halves 9 and 10 are replaced with right body half 37 and left body half 39 which contain a slot for slidably mounting trigger 38. All elements function as described in the first embodiment except the following difference. The trigger 38 holds the actuating member 20 in a cocked position. When the cord 2 is pulled, the trigger 38 releases the actuating member 20 and the actuating member 20 causes the pressurized container 11 to discharge. This type of trigger requires more force to release the actuating member 20 than the rotatable trigger 13 but can be used effectively for many applications.

A fifth embodiment of the invention is illustrated in FIGS. 11–16. In this embodiment the basic structure is as previously described in the first embodiment and like numbers are used to indicate like or corresponding parts.

In the anti-burglar device 3 previously described, the trigger 13 is released when cord 2 is pulled wherein. The trigger 13 holds the actuating member 20 in a cocked position. Rather than in this embodiment, the trigger 13 is replaced by a trigger 40 wherein the trigger 40 will be forced to rotate in the direction of arrow 48 by the action of the annular flange section 23 of the spring 16 urged actuating member 20. The operation of this trigger 40 will become apparent in the following description.

Figure 11:
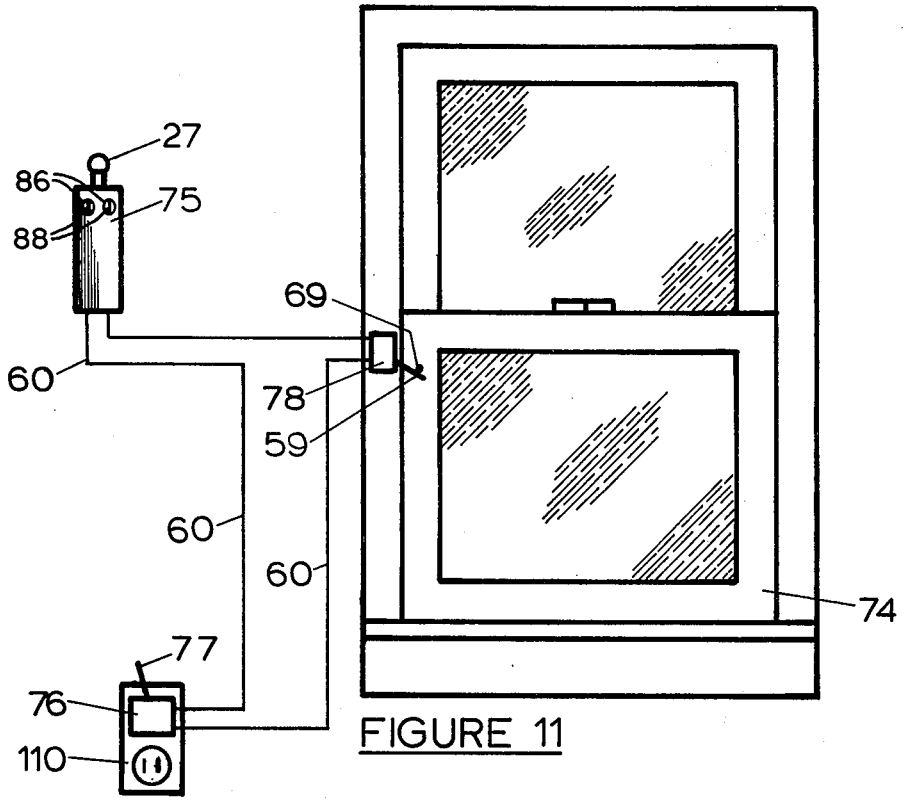
FIG. 11 is an elevational view of a wall of a room showing a fifth embodiment of the chemical dispensing anti-burglar device of the present invention secured to a wall and electrically connected to a switch at the window.
Figure 12:
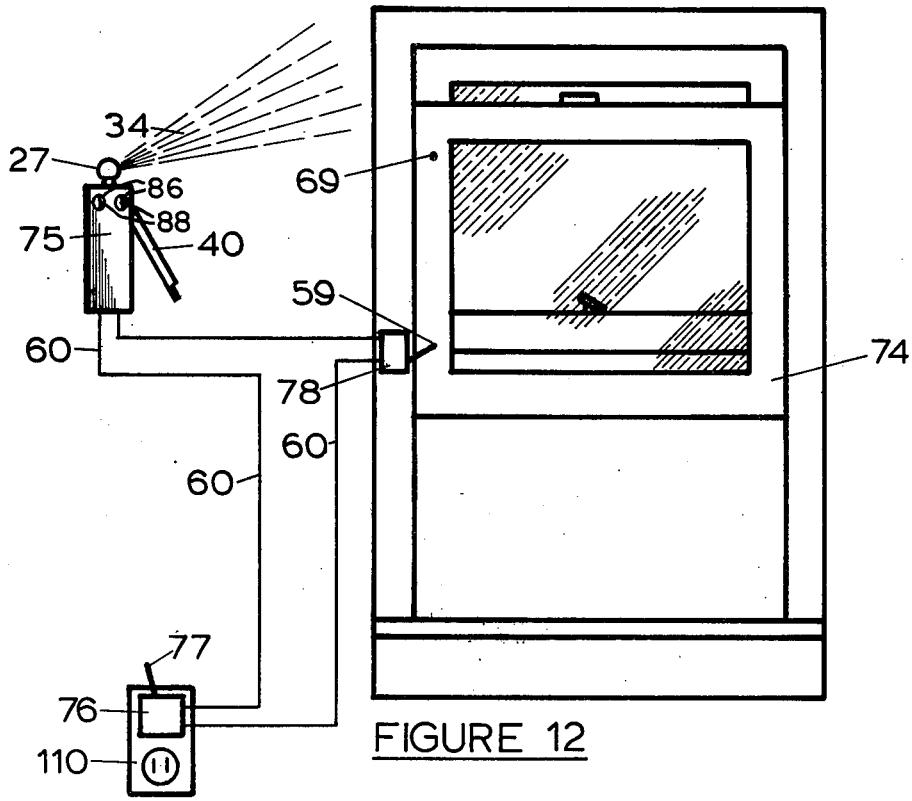
FIG. 12 is an elevational view similar to FIG. 11 but showing the window open and showing the device discharging.
Figure 17:
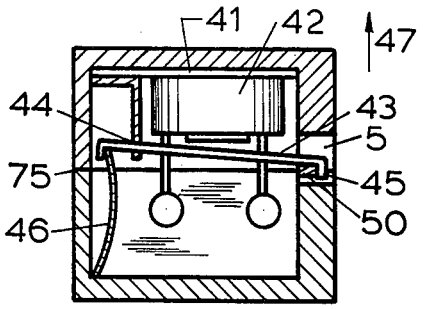
FIG. 17 is a partial top sectional showing the electromechanical actuator of the anti-burglar device wherein the trigger is electromechanically controlled.
Figure 16:
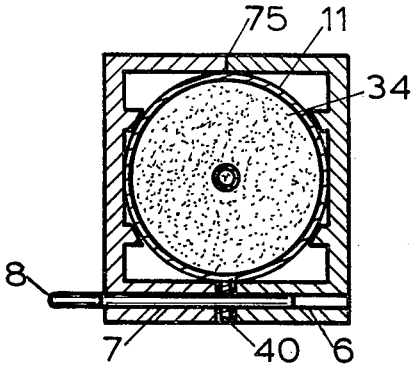
FIG. 16 is a partial horizontal section taken along line C—C of FIG. 13 with the trigger locked by the safety pin.

As shown in FIGS. 11 and 12, the device 75 can be remotely mounted from a window or other object or entryway to be protected and connected by means of an electrical cable 60 to an electrical switch 78; an on-off switch 77 and a power source 76, so that upon opening of the window sash 74 by an unauthorized person, the contacts of switch 78 will close as a result of switch activation pin 69 releasing contact lever 59 of switch 78 electromechanically causing the device 75 to discharge a chemical 34 into the area to be protected. This embodiment of the device comprises of all the components previously described except for the change in the method of triggering previously described and an addition of an electromechanical actuator 41.

Now referring to FIGS. 13–18, an electromechanical actuator 41 is shown. The electromechanical actuator 41 comprises an electromagnetic coil 42, a solenoid latch lever 43, a lever pivot point 44 and a latch lever spring 46. The components of the electromechanical actuator 41 are arranged in a manner such that when power is applied to the electromagnetic coil 42, a magnetic flux is generated, causing the latch lever 43 to be attracted toward the coil 42 and to rotate around pivot point 44. The rotation of the latch lever 43 will be confined from further movement by the electromagnetic coil 42. The latch lever 43 is held in a normal rest position by the action of spring 46 exerting force on the latch lever 43 in direction opposite that of arrow 47. This causes the catch 45 of latch lever 43 to move in the same direction and causes the latch lever 43 to rest against the trigger 40 and prevent the trigger 40 from rotating in the direction 48.

Figure 14:
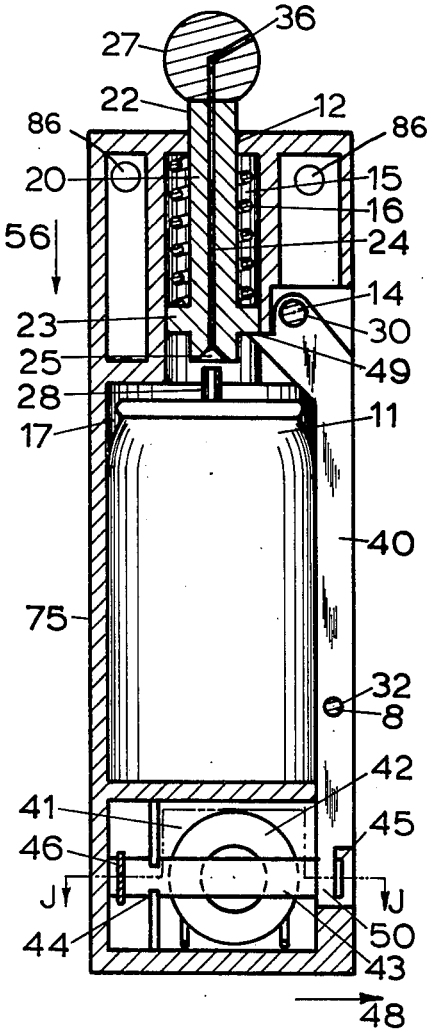
FIG. 14 is a partial vertical section taken along line D—D of FIG. 13 showing the actuating member in a cocked position.
Figure 13:
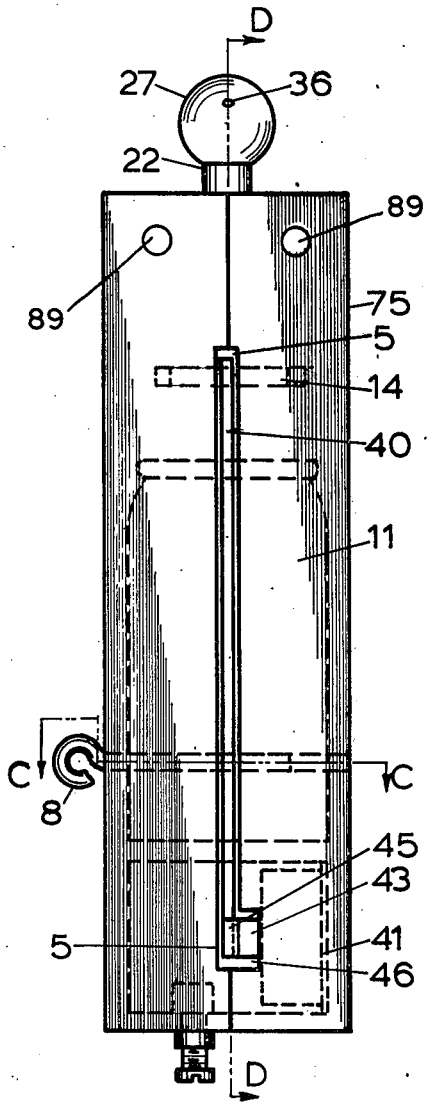
FIG. 13 is a front elevational view similar to FIG. 3 but showing a fifth embodiment of the anti-burglar dispensing device containing a pressurized container with a projecting spout.
Figure 18:
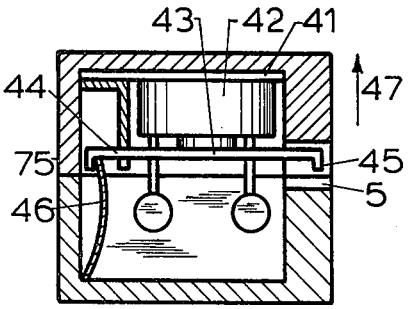
FIG. 18 is a partial top sectional of the anti-burglar device in its discharging position.

As can be best seen in FIG. 14, the annular flange section 23 of the spring 16 urged actuating member 20 engages with the latch portion 49 of the trigger 40 and will cause the trigger 40 to rotate in the direction of arrow 48 about pivot pin 14. The trigger 40 is releasably retained from rotating by the catch 45 of the latch lever 43 which is restrained from transverse movement by the pivot point 44.

When switch 48 is closed, electric power is applied to the electromagnetic coil 42, thus, energizing the electromagnetic coil 42. The solenoid latch lever 43 is pulled toward the electromagnetic coil 42 in direction 47 around pivot point 44 thereby moving the latch lever catch 45 away from engagement with the trigger 40 at notch 50; whereupon the annular flange section 23 of the spring 16 urged actuating member 20 engaging with the latch portion 49 of the trigger 40 causes the trigger 40 to rotate in the direction of arrow 48. This permits the spring 16 urged actuating member 20 to be moved in the direction of arrow 56 until the entry section 25 of the actuating member 20 is in seated engagement with the projecting dispensing spout 28 of the pressurized container 11; further movement of the actuating member 20 will depress the projecting spout 28 and cause the chemical 34 to be released from the pressurized container 11; through the dispensing spout 28, the entry section 25, the fluid passageway 24 and the orifice 36.

It is an important feature that the catch 45 of the latch lever 43 slide freely on the notch 50 of the trigger 40, hence a consistent release of the latch lever 43 may be obtained on a limited amount of electric power. The trigger 40 will then be securely held in its cocked position in engagement with the spring 16 urged actuating member 20 safe from accidental release.

With the trigger 40 in the cocked position shown in FIG. 14, the safety pin 8 may be inserted in passages 6, 7, and 32 to safely lock the trigger 40 from accidental discharge.

It is also an important feature that the catch 45 moves in a direction perpendicular to the plane of movement of trigger 40, thereby requiring only a small movement of the latch lever 43 permitting the use of a smaller, lower powered electromechanical actuator 41 than would be required if trigger 40 was moved throughout its entire range by electromechanical action or then would be required by an electromechanical actuator acting transversly on the annular flange section 23.

Figure 20:
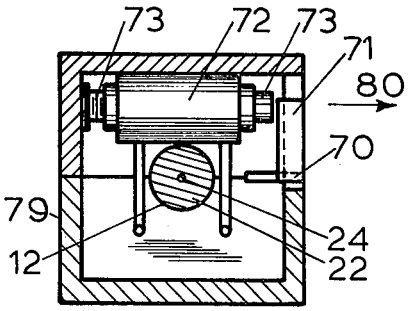
FIG. 20 is a partial horizontal section taken along the line E—E of FIG. 19.
Figure 15:
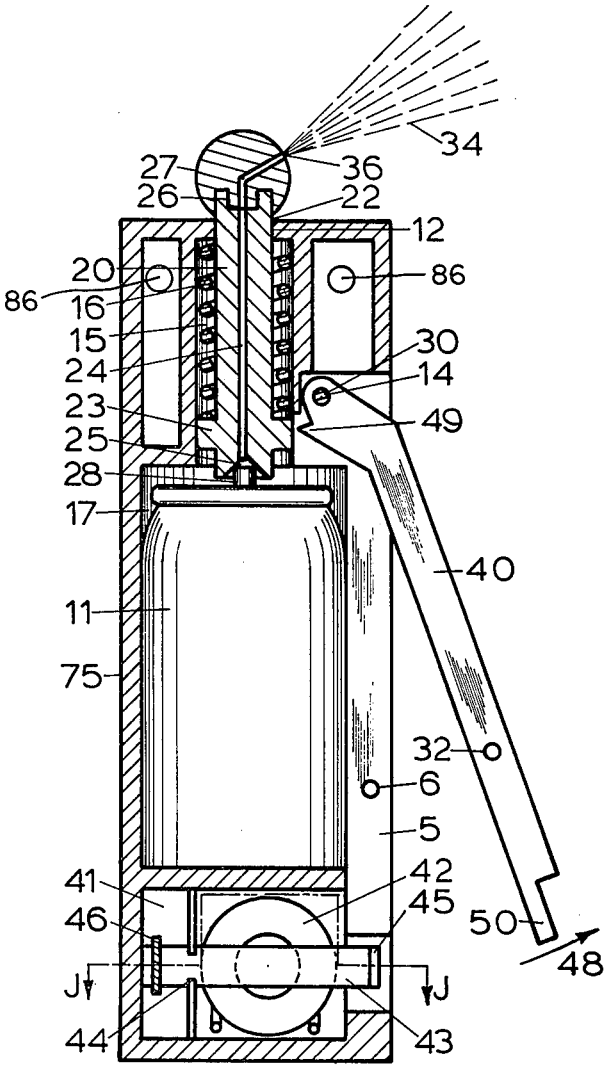
FIG. 15 is a partial vertical section taken along line D—D of FIG. 13 similar to FIG. 14 but showing the actuating member in its released position after the device has been triggered.
Figure 19:
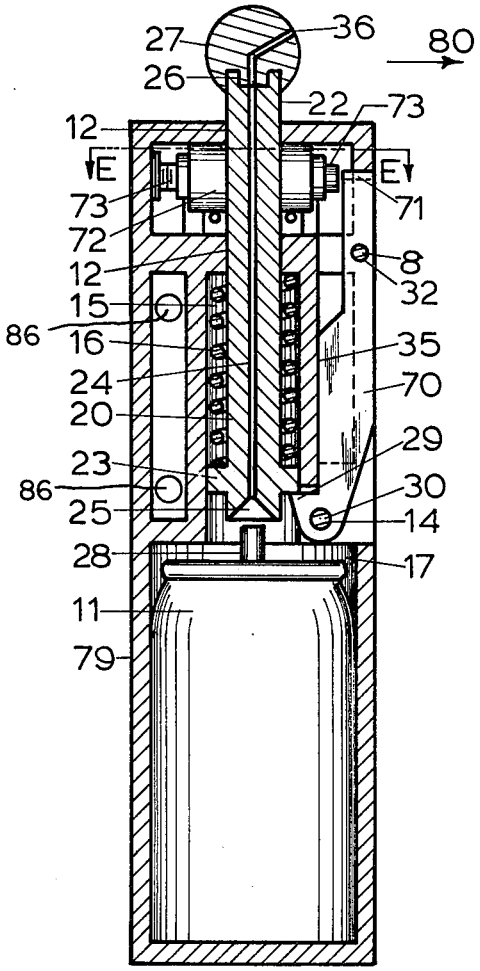
FIG. 19 is a partial vertical section similar to FIG. 4 but showing a sixth embodiment wherein the anti-burglar device can be triggered electromechanically.

A sixth embodiment of the invention is illustrated in FIGS. 19 and 20. In this embodiment the basic structure is as previously described in the first embodiment and like numbers are used to indicate like or corresponding parts.

In this embodiment, the trigger 13 is replaced by a trigger 70 wherein the notch 33 of trigger 13 is replaced with an extension 71. In addition, the device 79 is equipped with an electromechanical actuator 72 of the solenoid push type wherein the solenoid plunger 73 is mounted to engage the extension 71 of trigger 70.

The device 79 is installed in the manner described in the fifth embodiment and shown in FIGS. 11 and 12 wherein the device 75 is replaced by device 76. As the window 74 is raised; the solenoid coil is energized and the plunger 73 moves in the direction 80, pushing on extension 71 of trigger 70. This releases the actuating member 20 previously described and discharges the device.

Figure 22:
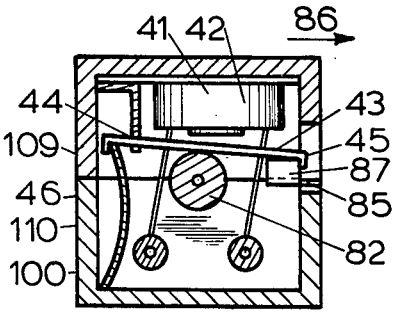
FIG. 22 is a partial horizontal section taken along the line F—F of FIG. 21.
Figure 21:
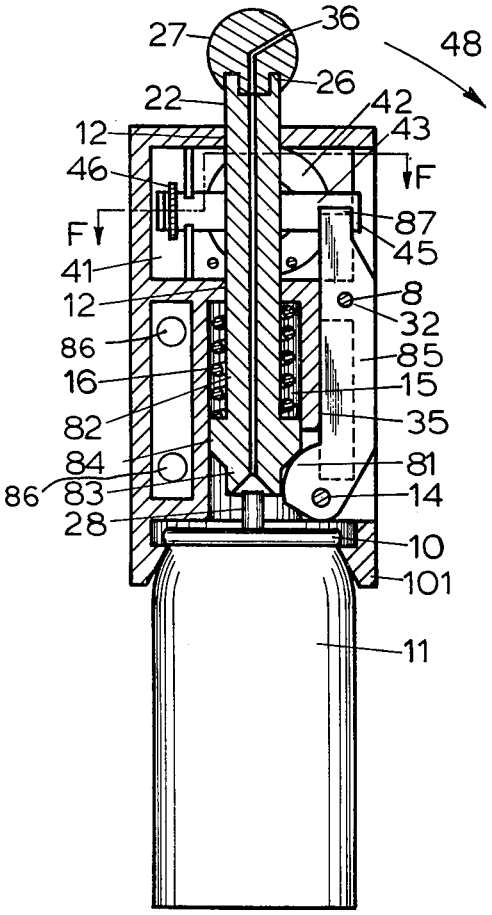
FIG. 21 is a partial vertical section similar to FIG. 4 but showing a seventh embodiment wherein the anti-burglar device can be triggered by an electromechanical actuator.

A seventh embodiment of the invention is illustrated in FIGS. 21 and 22. In this embodiment, the structure is as previously described in the fifth embodiment and like numbers are used to indicate like or corresponding parts.

In this embodiment, the annular flange section 23 of the actuating member 20 is replaced with an actuating member 82 containing a beveled surface 83 on its annular flange section 84; and the trigger catch 49 of trigger 40 is replaced by a beveled section 81 of a trigger 85.

In this embodiment, an electromechanical actuator 41 is installed and operates in a like manner as described in the fifth embodiment. The spring 16 urged actuating member 82 acting through the beveled flange section 83 and acting through cammed engagement with the beveled surface 81 of trigger 85 will rotate the trigger 85 in the direction 86. The catch 45 of latch lever 43 of the electromechanical actuator 41 will hold the trigger 85 in releasable engagement until the electromechanical actuator 41 is electrically energized thus causing discharge.

Figure 24:
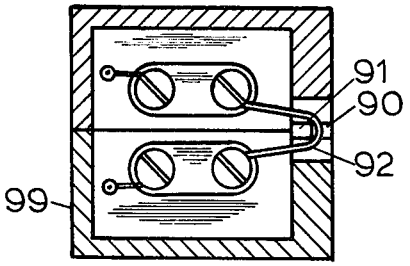
FIG. 24 is a partial horizontal section taken along the line G—G of FIG. 23.
Figure 23:
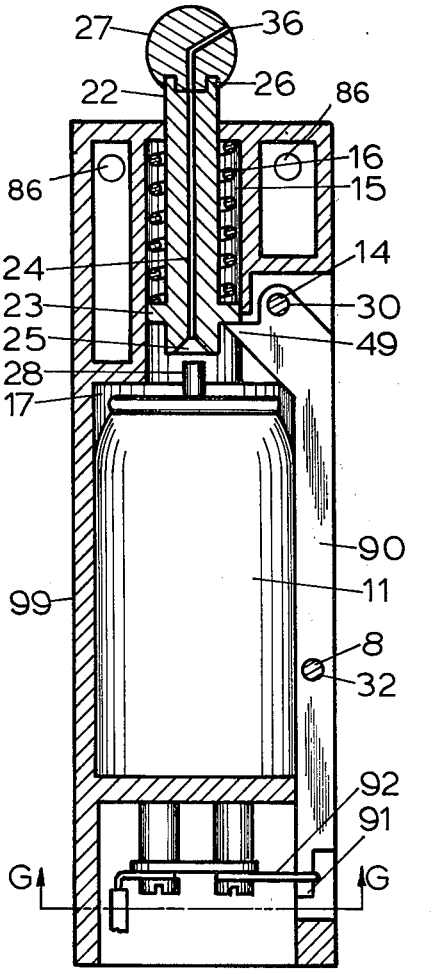
FIG. 23 is a partial vertical section similar to FIG. 14 but showing an eighth embodiment wherein the anti-burglar device can be discharged by passing an electrical current through a fusible link.

An eighth embodiment of the invention is illustrated in FIGS. 23 and 24. In this embodiment, the basic structure is as described in the fifth embodiment and like numbers are used to indicate like or corresponding parts. The chemical dispensing anti-burglar device of this embodiment is generally noted device 99.

In this embodiment, the trigger 90 is mounted for movement wherein the trigger 90 will be forced to rotate in the direction of arrow 48 by the action of the annular flange section 23 of the spring 16 urged actuating member 20. Therefore, the trigger actuating means in this embodiment is the annular flange section 23 of the spring biased actuating member 20 arranged to cause the trigger 90 to rotate in the direction of arrow 48, all of which is shown in FIGS. 23 & 24. A means for releasably retaining the trigger 90 is shown as a fusible link 92 which is mounted to prevent movement of trigger 90 shown for convenience as engaging the trigger 90 at notch 91. Thus, the trigger 90, with the safety pin removed, can not move until the fusible link 92 is removed from its retaining position. The fusible link 92 will safely retain the trigger 90 from rotation until an electric current is passed through the fusible link 92 in a manner previously described causing fusible link 92 to melt whereby the spring urged actuating member 20 acting on trigger 90 will cause the trigger 90 to rotate in the direction of arrow 48. This permits the actuating member 20 to move its dispensing element actuating means into engagement with the fluid-dispensing element; which causes fluid discharge.

Figure 25:
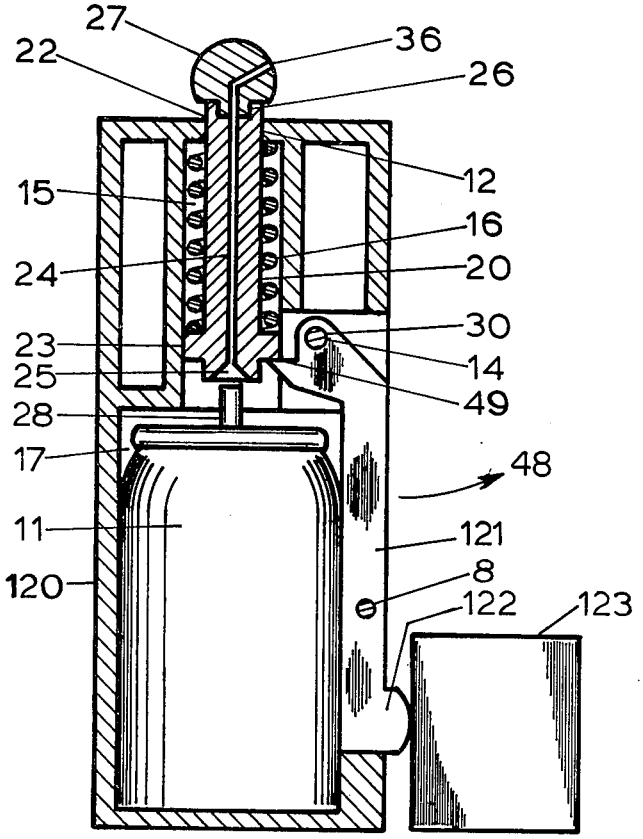
FIG. 25 is a vertical section similar to FIG. 14 wherein the trigger is held in shouldered engagement with the firing member by a movable object thereby retaining trigger in its actuation position.

A ninth embodiment of the invention is shown in FIG. 25. In this embodiment, the basic structure is as previously described in the fifth embodiment and like numbers are used to indicate like or corresponding parts. The chemical dispensing anti-burglar device of this embodiment is generally noted device 120.

Figure 26:
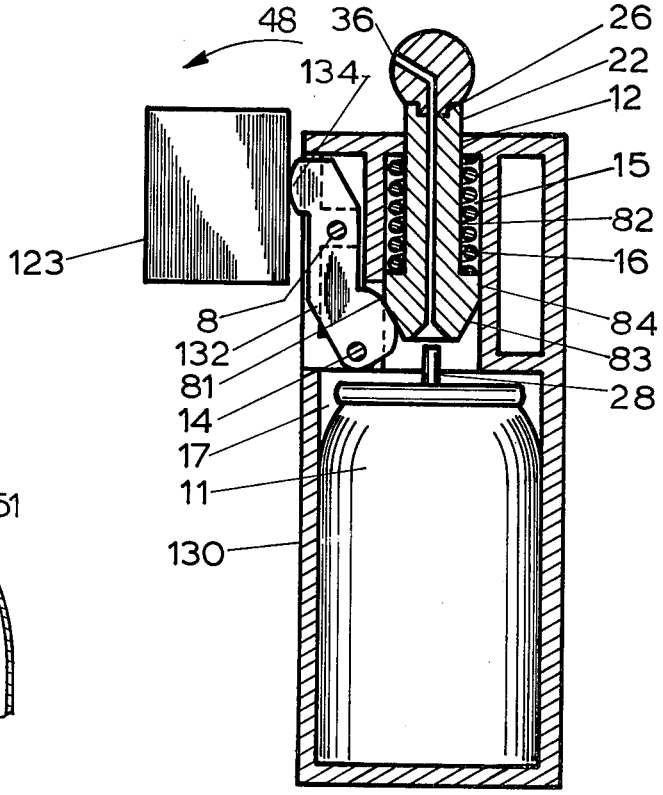
FIG. 26 is a vertical section similar to FIG. 21 wherein the trigger is held in cammed engagement with the firing member by a movable object thereby retaining the trigger in its actuation position.

In this embodiment, the releasably retaining means acting on the trigger 121 is a movable object 123 which replaces the electromechanical actuator of the fifth embodiment. Any movable object such as a window, door, TV set, Hi Fi set etc. can be mounted to retain the release lever 121. If it is desired to move the protected object; the safety pin 8, previously described, is inserted in a manner to engage hole 32 thus safely deactivating the device. However, if properly installed, the intruder will not notice device 121 and move the protected object and cause discharge. It is important in this embodiment that the means for releasably retaining the trigger 121 be a movable object, shown for convenience as a block 123, separate from the device 120 and be so positioned that upon movement will release trigger 121. It is also important that the trigger 121 is mounted for movement and arranged that the spring biased actuating member 20 will move the trigger 121 toward the movable object 123. Upon movement of the movable object 123, the trigger 121 will be moved by the actuating member 20 whereby the fluid-dispensing element and the dispensing element actuating means will be forced together to cause discharge:

A tenth embodiment of the invention is shown in FIG. 26. In this embodiment, the basic structure is as previously described in the seventh embodiment and like numbers are used to indicate like or corresponding parts. The chemical dispensing anti-burglary device of this embodiment is generally noted device 130. This embodiment is installed in a manner described in the ninth embodiment.

The chemical dispensing anti-burglary devices described herein in several embodiments was generally shown with a pressurized container 11 with a projecting dispensing spout 28 mounted to discharge into a funnel like entry section 25 of a fluid passageway 24 when the device is discharged. Alternately the devices 75, 79, 99, 109, 120 and 130 will also function with a pressurized container of the aerosol type with a recessed valve by providing a tubular member depending from the actuating member to cause discharge; in addition the devices can be used with a sealed pressurized container with a piercable section; also the aerosol type container with a dispensing projecting cap wherein the actuating member depresses the projecting cap to cause discharge; but the invention is not limited to these type of containers.

The chemical dispensing anti-burglar device described herein all embodiments were generally shown with the pressurized container enclosed within the housing halves. The housing can be adopted to a wide variety of pressurized containers and the housing can be made in the form of a cap to mount over the discharging means of the pressurized container whereby the remaining portion of the pressurized container will not be enclosed as shown in FIG. 21.

Although I have herein shown and described the invention in what I have conceived to be the most practical and preferred embodiments, it is recognized that departure may be made therefrom within the scope of our invention, which is not to be limited to the details disclosed herein, but is to be accorded the full scope of the claims so as to embrace any and all equivalent structures and devices.

I claim:

1. A chemical dispensing anti-burglar booby trap device for use with a pressurized container having a fluid-dispensing element adapted to release fluid under pressure when actuated, the device comprising:

a. a body member mounted on support means;

b. means for supporting said pressurized container in said body member;

c. an actuating member slidably supported in said body member, a fluid passageway contained within said actuating member and arranged to extend through a wall of said body member, said passageway having an entry section at one end thereof and an adjustable dispensing head on the other end thereof;

d. dispensing element actuating means mounted on said actuating member and adapted to engage and actuate said fluid-dispensing element;

e. spring means biased to force said fluid-dispensing element and said dispensing element actuating means into engagement with each other, thereby causing said fluid-dispensing element to be actuated;

f. a means for forming a seal between said fluid dispensing element and said entry section whereby fluid will be discharged therethrough from said container into said passageway, said seal being formed upon movement of said actuating member when said actuating member is released;

g. trigger means adapted to releasably retain said spring means in a cocked position in which said fluid-dispensing element and said dispensing element actuating means are separated from each other;

h. trigger-actuating means associated with said trigger to actuate said trigger upon the application of force to said trigger-actuating means, whereby said spring is released from its cocked position causing said fluid-dispensing element to be actuated, and fluid under pressure is released from said container to pass through said passageway.

2. The chemical dispensing anti-burglar device of claim 1 in which the pressurized container includes a piercable section, and means for puncturing said piercable section, whereby fluid may be discharged.

3. The chemical dispensing anti-burglar device of claim 2 in which said means for puncturing includes a projecting forward section, said projecting forward section being formed around said entry section extending toward said container to pierce said piercable section.

4. The chemical dispensing anti-burglar device of claim 1 wherein said pressurized container includes a dispensing valve actuated to permit fluid discharge therethrough upon depression thereof, said valve being actuated to said release position through movement of said spring biased actuating member causing depression of said valve, thus cause discharge.

5. The chemical dispensing anti-burglar device of claim 4, wherein said valved pressurized container includes a projecting dispensing spout, said dispensing spout discharging fluid upon depression, said entry section being funnel shaped for receiving said projecting dispensing spout on said container.

6. The chemical dispensing anti-burglar device of claim 4 wherein said valved pressurized container includes a recessed valve, said biased actuating member includes a projecting forward section around said entry section extending toward said container to engage said recessed valve, said recessed valve actuated upon depression to emit fluid.

7. The chemical dispensing anti-burglar device of claim 1 wherein said trigger is mounted for rotation between said actuation position and said release position.

8. The chemical dispensing anti-burglar dispensing device of claim 1 wherein said trigger is mounted for sliding movement between said actuation position and said release position.

9. The chemical dispensing anti-burglar device of claim 1 wherein said trigger when in said actuation position is in shouldered engagement with said biased actuating member to retain said biased actuating member in said cocked position.

10. The chemical dispensing anti-burglar device of claim 1 wherein said trigger when in said actuation position is in cammed engagement with said biased actuating member to retain said biased actuating member in said cocked position.

11. The chemical dispensing anti-burglar device of claim 1 wherein said trigger-actuating means includes a means for attaching a cord to said trigger, said cord arranged to cause movement of said trigger thereby causing fluid discharge.

12. The chemical dispensing anti-burglar device of claim 1 and a means for electromechanically retaining and releasing said trigger.

13. The chemical dispensing anti-burglar device of claim 12 wherein said electromechanical retaining-releasing means comprises a solenoid latch layer for holding said trigger in said actuation position, said solenoid lever being resiliently held in engagement with said trigger to retain said biased actuating member in said cocked position and a magnetic cored coil for moving said solenoid layer out of engagement with said trigger element whereby said trigger moves to said release position.

14. The chemical dispensing anti-burglar device of claim 1 and a means for moving said trigger element from said actuation position to said release position, said trigger moving means comprising of a solenoid containing an electromagnetic coil and a plunger, said electromagnetic coil and plunger being mounted to a cause release of said trigger when said electromagnetic coil is electrically energized.

15. The chemical dispensing anti-burglar device of claim 1 and a means for retaining said trigger element in said actuation position, said retaining means comprising of a fusible link mounted in engagement with said trigger element to retain said trigger element in a cocked position, said fusible link releasing said trigger element when an electric current is passed through said fusible link.

16. The chemical dispensing anti-burglar device of claim 1 wherein said trigger is in cammed engagement with a shaped surface of said actuating member, said cammed engagement arranged to move said trigger from said actuation position to said release position, means for holding said trigger in engagement with said actuating member, said trigger holding means mounted for movement between a holding and a release position, said holding means in said holding position releasably retaining said trigger in engagement with surface of said actuating member, said holding means in said release position permitting said trigger to move to its release position.

17. The chemical dispensing anti-burglar device of claim 1 wherein said device includes a trigger locking means, said trigger locking means including a pin, said pin being mounted for an insertion position and a removable position, said pin in said insertion position being mounted in a manner to prevent movement of said trigger, said removable position having pin removed permitting movement of said trigger when actuated.

18. A chemical dispensing anti-burglar booby trap device for attachment to a surface such as a wall and associated with a movable object such as a window to prevent burglary by filling the area associated with said device with a chemical such as tear gas when unauthorized movement of said movable object is attempted, the device comprising:

a. a body member having mounting means for securing said body member to one surface;

b. a pressurized container supported in said body member, said pressurized container having a fluid dispensing element adapted to release fluid under pressure when actuated;

c. an actuating member slidably supported in said body member, a fluid passageway contained within said actuating member and arranged to extend through a wall of said body member, said passageway having an entry section at one end thereof and an adjustable rotatable dispensing head on the other end thereof;

d. dispensing element actuating means mounted on said actuating member and adapted to engage and actuate said fluiddispensing element;

e. spring means biased to force said fluid-dispensing element and said dispensing element actuating means into engagement with each other, thereby causing said fluid-dispensing element to be actuated, f. a means for forming a seal between said discharging means and said entry section whereby fluid will be discharged therethrough from said container into said passageway, said seal being formed upon movement of said actuating member when said actuating member is released;

g. trigger means adapted to releasably retain said spring means in a cocked position in which said fluid-dispensing element and said dispensing element actuating means are separated from each other;

h. and means for releasably retaining said trigger in said cocked position by a movable object, upon movement of said movable object from a first position to a second position relative to said surface, said trigger means moves from said cocked position to a release position wherein said dispensing element actuating means of said actuating member is forced into engagement with said fluid-dispensing element to discharge pressurized fluid from said container.

* * * * *